US009417544B2

(12) United States Patent
Kmiecik-Lawrynowicz et al.

(10) Patent No.: US 9,417,544 B2
(45) Date of Patent: Aug. 16, 2016

(54) LOW ENERGY CONSUMPTION MONOCHROME TONER FOR SINGLE COMPONENT DEVELOPMENT SYSTEM

(71) Applicant: XEROX CORPORATION, Norwalk, CT (US)

(72) Inventors: Grazyna E. Kmiecik-Lawrynowicz, Fairport, NY (US); Robert D. Bayley, Fairport, NY (US); Maura A. Sweeney, Irondequoit, NY (US); Daniel W. Asarese, Honeoye Falls, NY (US); Karen L. Lamora, Marion, NY (US)

(73) Assignee: XEROX CORPORATION, Norwalk, CT (US)

( * ) Notice: Subject to any disclaimer, the term of this patent is extended or adjusted under 35 U.S.C. 154(b) by 46 days.

(21) Appl. No.: 14/175,957

(22) Filed: Feb. 7, 2014

(65) Prior Publication Data

US 2015/0227072 A1 Aug. 13, 2015

(51) Int. Cl.

| | |
|---|---|
| ***G03G 9/087*** | (2006.01) |
| ***G03G 9/097*** | (2006.01) |
| ***G03G 9/08*** | (2006.01) |
| ***G03G 9/093*** | (2006.01) |

(52) U.S. Cl.

CPC ..... *G03G 9/09725* (2013.01); *G03G 9/0825* (2013.01); *G03G 9/09314* (2013.01); *G03G 9/09342* (2013.01); *G03G 9/09364* (2013.01); *G03G 9/09371* (2013.01); *G03G 9/09392* (2013.01); *G03G 9/09733* (2013.01)

(58) Field of Classification Search

CPC ..... G03G 9/093; G03G 9/09708; G03G 9/09716; G03G 9/09725; G03G 9/09733

See application file for complete search history.

(56) References Cited

U.S. PATENT DOCUMENTS

| | | | | |
|---|---|---|---|---|
| 4,158,634 | A * | 6/1979 | Amariti | C08J 3/14 241/15 |
| 6,566,025 | B1 * | 5/2003 | McStravick et al. | 430/108.11 |
| 7,208,252 | B2 | 4/2007 | Grande et al. | |
| 7,862,971 | B2 * | 1/2011 | Moffat | G03G 9/0804 399/252 |
| 2010/0026111 | A1 | 2/2010 | Monzel | |
| 2010/0075245 | A1 * | 3/2010 | Watanabe et al. | 430/123.41 |
| 2010/0330486 | A1 * | 12/2010 | Zhou et al. | 430/108.4 |
| 2012/0070771 | A1 * | 3/2012 | Araki et al. | 430/108.3 |

* cited by examiner

*Primary Examiner* — Peter Vajda
(74) *Attorney, Agent, or Firm* — Shimokaji IP

(57) ABSTRACT

A low energy consumption monochrome toner includes a surface additive package having a high charging silica compound, an aerating silica compound, a colloidal silica compound, a polymeric spacer, and a crosslinked spacer. The low energy consumption monochrome toner is suitable for high speed printing in SCD systems while decreasing minimum fusing temperature, maintaining excellent hot offset and storage, and exhibiting a matte finish.

18 Claims, No Drawings

LOW ENERGY CONSUMPTION MONOCHROME TONER FOR SINGLE COMPONENT DEVELOPMENT SYSTEM

TECHNICAL FIELD

This disclosure is generally directed to toner compositions for use, such as in a single component development system (SCD system). More specifically, this disclosure is directed to a low energy consumption monochrome toner composition exhibiting low minimum fusing temperature and low gloss levels, and methods for producing such a toner composition.

BACKGROUND

High speed single component development systems (SCD systems) have been built to satisfy the high demands of an office network market. In SCD systems, an electrostatic latent image is formed on a photoconductor to which toner is attracted. The toner is then transferred to a support material, such as a piece of paper, and then fused to the support material by heat, forming an image. As printing demands increase, printers are required to print at higher speeds; thus, the toner must be heat/pressure fused to the paper in ever shortening times. A solution is to use toner with a lower melting temperature to overcome this problem. However, lower melting temperature toners tend to fuse together during storage.

There remains a need for an improved, low energy consumption monochrome toner suitable for high speed printing, particularly in SCD systems, and that can provide excellent flow, charging, lower toner usage, and reduced drum contamination, while maintaining gloss levels suitable for a matte finish.

SUMMARY

The following detailed description is of the best currently contemplated modes of carrying out exemplary embodiments herein. The description is not to be taken in a limiting sense, but is made merely for the purpose of illustrating the general principles of the disclosure herein, since the scope of the disclosure herein is best defined by the appended claims.

Various inventive features are described below that can each be used independently of one another or in combination with other features. However, any single inventive feature may not address any of the problems discussed above or may only address one of the problems discussed above. Further, one or more of the problems discussed above may not be fully addressed by any of the features described below.

Broadly, embodiments of the present disclosure herein generally provide a low energy consumption monochrome toner including a surface additive package including a high charging silica compound, an aerating silica compound, a colloidal silica compound, a polymeric spacer, and a crosslinked spacer.

In another aspect of the present disclosure herein, a low energy consumption monochrome toner includes a core latex having a weight average molecular weight (Mw) of from about 15 kpse to about 75 kpse and a glass transition temperature (Tg) of from about 35° C. to about 75°; and a surface additive package including a silica mixture, a polymeric spacer, and a crosslinked spacer.

In another aspect of the present disclosure herein, a low energy consumption monochrome toner comprises a core latex; a shell latex having a weight average molecular weight (Mw) of from about 15 kpse to about 75 kpse and a glass transition temperature (Tg) of from about 45° C. to about 75°; and a surface additive package over the shell latex, with the surface additive package including a silica mixture, a polymeric spacer, and a crosslinked spacer.

DETAILED DESCRIPTION

In the present disclosure, the term "high speed printing" refers to printing devices running at greater than about 35 pages per minute.

In the present disclosure, the term "low energy consumption toner" refers to a toner that enables the use of a cooler fuser in a printing system and, therefore, less energy is consumed.

In the present disclosure, the term "monochrome toner" refers to a toner having a single color, typically black.

In the present disclosure, the term "hot offset temperature" refers to the maximum temperature at which toner does not significantly adhere to a fuser roll during fixing in a printing system.

In the present disclosure, the term "drum contamination" refers to an unacceptable amount of toner adhered on a drum of a printing system after fusing.

In the present disclosure, the term "minimum fusing temperature" refers to the minimum temperature at which acceptable adhesion of the toner to a substrate occurs in a printing system.

In the present disclosure, the term "matte finish" refers to gloss values (GGUs) of about 0 to about 30.

The present disclosure provides a low energy consumption monochrome toner suitable for printing in SCD systems, improved hot offset temperature and storage stability (blocking resistance), and a matte finish. The present disclosure also provides methods for producing a low energy consumption monochrome toner.

SUMMARY

The low energy consumption monochrome toner herein may include particles that comprise a core including a latex containing one or more monomers, a low melt wax, a colorant including carbon black pigment and cyan blue, a coagulant agent, and a surface additive package. The surface additive package may comprise a mixture of a high charging silica compound, an aerating silica compound, a colloidal silica compound, a polymeric spacer, and a crosslinked spacer.

In other embodiments, the particles herein may have a core-shell structure. Included with the above core may be a low melt wax, a coagulant agent and a chelating agent. The shell may include a latex having a lower or higher weight average molecular weight (Mw) and a higher glass transition temperature (Tg) than the latex in the core of the particle.

While the latex polymer may be prepared by any method within the purview of those skilled in the art, in embodiments herein, the latex polymer may be prepared by emulsion polymerization methods, including semi-continuous emulsion polymerization.

In this embodiment, using semi-continuous emulsion polymerization, the core of the particle can be prepared by forming a monomer emulsion comprising one or more monomers in the presence of a surfactant and distilled water. A portion of the monomer emulsion is heated and stirred for a predetermined time to allow seed particle formation. Then, the remaining monomer emulsion is added into the reactor. The monomer emulsion is stirred to complete the conversion of the monomer to form the polymerized latex. Then, the polymerized latex is mixed in a homogenizer with at least one colorant, a low melt wax, and distilled water. A solution containing a coagulant and $HNO_3$ solution is added to the reactor.

Once the core is formed, a shell may be formed over the core. In embodiments, the shell may be prepared by producing a shell latex according to semi-continuous emulsion polymerization as described above in the preparation of the core of the particle. The shell latex can be added drop-wise to the reactor containing the core. After the complete addition of the shell latex, the mixture is held for a period of time then pH adjusted to halt growth. The resulting particle slurry can be stirred, heated for a period of time at coalescence temperatures, cooled, and the pH adjusted. The core-shell particles can then be washed several times and dried.

A surface additive package may be mixed with the washed and dried particles. The components of the surface additive package are selected to enable improved toner flow properties, high toner charge, charge stability, denser images, and lower drum contamination.

Core

Any latex resin may be utilized in forming the core according to embodiments herein. Such resins, in turn, may be made of any suitable monomer. In embodiments, the monomer used to form the core may be a low molecular weight monomer having a weight average molecular weight (Mw) of from about 15 kpse to about 75 kpse, or from about 25 kpse to about 55 kpse, or from about 30 kpse to about 50 kpse. The molecular weight may be measured by high flow or mixed bed gel permeation chromatography.

In various embodiments, a glass transition temperature (Tg) of the latex of the core may be from about 35° C. to about 75° C., or from about 40° C. to about 70° C., or from about 45° C. to about 55° C.

In addition, the monomer for the core may contain a carboxylic acid selected, for example, from the group comprised of, but not limited to, acrylic acid, methacrylic acid, itaconic acid, β-CEA, fumaric acid, maleic acid and cinnamic acid.

Examples of suitable monomers useful in forming a core latex polymer emulsion, and thus the resulting latex particles in the latex emulsion, include, but are not limited to thermoplastic resins such as vinyl monomers, styrenes, and polyesters.

Examples of suitable thermoplastic resins include styrene methacrylate; polyolefins; styrene acrylates; styrene butadienes; crosslinked styrene polymers; epoxies; polyurethanes; vinyl resins, including homopolymers or copolymers of two or more vinyl monomers; and polymeric esterification products of a dicarboxylic acid and a diol comprising a diphenol.

Other suitable vinyl monomers include styrene; p-chlorostyrene; unsaturated mono-olefins such as ethylene, propylene, butylene, and isobutylene; saturated mono-olefins such as vinyl acetate, vinyl propionate, and vinyl butyrate; vinyl esters such as esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile; methacrylonitrile; acrylamide; and mixtures thereof. In addition, crosslinked resins, including polymers, copolymers, and homopolymers of styrene polymers may be selected.

Exemplary polymers include poly-styrene acrylates, poly-styrene butadienes, poly-styrene methacrylates and, more specifically, poly(styrene-alkyl acrylate), poly(styrene-1,3-diene), poly(styrene-alkyl methacrylate), poly (styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly (styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly (methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly (styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and combinations thereof. The polymers may be block, random, or alternating copolymers.

In embodiments, the monomer may be styrene, n-butylacrylate and beta carboxyethylacrylate at a ratio of, for example, from about 83/17/5 parts to about 70/30/2 parts, or from about 79/21/3 parts to about 65/35/12 parts, or from about 75/25/3 parts to about 70/30/2 parts.

Low Melt Wax

A low melt wax or waxes may be added during formation of the core latex resin. The low melt wax may be added to improve particular toner properties, such as particle shape, fusing characteristics, gloss, stripping, and high offset temperature. The low melt wax may help to decrease minimum fusing temperature, increase melt index flow (MFI), and aid in improved release of toner particles from the fuser roll. In embodiments, the low melt wax has a melting point of less than about 80° C., or about 47° C. to about 78° C., or less than about 76° C.

Suitable waxes include, for example, natural vegetable waxes, natural animal waxes, mineral waxes, synthetic waxes, and functionalized waxes. Natural vegetable waxes include, for example, carnauba wax, candelilla wax, rice wax, sumacs wax, jojoba oil, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes include, for example, Fischer-Tropsch wax; acrylate wax; fatty acid amide wax; silicone wax; polytetrafluoroethylene wax; polyethylene wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, diglyceryl distearate, dipropyleneglycol distearate, and triglyceryl tetrastearate; sorbitan higher fatty acid ester waxes, such as sorbitan monostearate; and cholesterol higher fatty acid ester waxes, such as cholesteryl stearate; polypropylene wax; and mixtures thereof.

In embodiments, the low melt wax may be, for example, paraffin (melting point 47° C.-65° C.), bamboo leaf (melting point 79° C.-80° C.), bayberry (melting point 46.7° C.-48.8° C.), beeswax (melting point 61° C.-69° C.), candelilla (melting point 67° C.-69° C.), cape berry (melting point 40.5° C.-45° C.), carandá (melting point 79.7° C.-84.5° C.), carnuba (melting point 83° C.-86° C.), castor oil (melting point 83° C.-88° C.), and Japan wax (melting point 48° C.-53° C.).

The low melt wax may be present in an amount of from about 1% by weight to about 25% by weight of the core, or from about 3% by weight to about 15% by weight of the core, or from about 12% by weight to about 25% by weight of the core. In embodiments, the amount of low melt wax present in the core of the present disclosure may be about half of the amount of wax used in a core when using a high melt wax.

Colorant

The core herein may also contain one or more colorants. For example, colorants used herein may include pigment, dye, mixtures of pigment and dye, mixtures of pigments, mixtures of dyes, and the like. The colorant may comprise, for example, carbon black, magnetite, black, cyan, magenta, yellow, red, green, blue, brown, and mixtures thereof. In embodiments, suitable colorants include a carbon black pigment and cyan blue. The colorant(s) may be incorporated in an amount sufficient to impart the desired color to the toner.

Carbon black pigments may be present in core particles herein to improve the image density. The carbon black pigment may be, for example, carbon black products from Cabot® Corporation, for example, Black Pearl carbon black; carbon black products from Regal; carbon blacks from Condutex; carbon blacks from Columbian Chemicals, for example, Raven® carbon blacks: Raven Beads, Raven Black, Raven C, and Raven P-FE/B; carbon blacks by LanXess; carbon blacks by Mitsubishi®; carbon blacks by NiPex; carbon blacks by BASF®; Normandy Magenta RD-2400 by Paul Uhlrich®; Permanent Violet VT2645 by Paul Uhlrich®; Heliogen Green L8730 by BASF®; Argyle Green XP-111-S by Paul Uhlrich®; Brilliant Green Toner GR 0991 by Paul Uhlrich®; Lithol Scarlet D3700 by BASF®; Toluidine Red by Aldrich®; Scarlet for Thermoplast NSD Red by Aldrich®; Lithol Rubine Toner by Paul Uhlrich®; Lithol Scarlet 4440 and NBD 3700 by BASF®; Bon Red C by Dominion Color®; Royal Brilliant Red RD-8192 by Paul Uhlrich®; Oracet Pink RF by Ciba Geigy®; Paliogen Red 3340 and 3871 K by BASF®; Lithol Fast Scarlet L4300 by BASF®; Heliogen Blue D6840, D7080, K7090, K6910 and L7020 by BASF®; Sudan Blue OS by BASF®; Neopen Blue FF4012 by BASF®; PV Fast Blue B2G01 by American Hoechst®; Irgalite Blue BCA by Ciba Geigy®; Paliogen Blue 6470 by BASF®; Sudan II, III and IV by Matheson, Coleman, and Bell; Sudan Orange by Aldrich®; Sudan Orange 220 by BASF®; Paliogen Orange 3040 by BASF®; Ortho Orange OR 2673 by Paul Uhlrich®; Paliogen Yellow 152 and 1560 by BASF®; Lithol Fast Yellow 0991K by BASF®; Paliotol Yellow 1840 by BASF®; Novaperm Yellow FGL by Hoechst®; Permanerit Yellow YE 0305 by Paul Uhlrich®; Lumogen Yellow D0790 by BASF®; Suco-Gelb 1250 by BASF®; Suco-Yellow D1355 by BASF®; Suco Fast Yellow D1165, D1355 and D1351 by BASF®; Hostaperm Pink E by Hoechst®; Fanal Pink D4830 by BASF®; Cinquasia Magenta by DuPont®; Paliogen Black L9984 9 by BASF®; and Pigment Black K801 by BASF®.

Carbon black may be present in the core of the present disclosure, for example, in an amount of from about 1% by weight to about 8% by weight of the core, or from about 2% by weight to about 6% by weight of the core, or from about 3% by weight to about 5% by weight of the core.

Cyan blue may improve the tint of the toner and may also help to add charge to the particles. The cyan blue may be present in the particle of the disclosure, for example, in an amount of from about 0.25% by weight to about 3.25% by weight of the core, or from about 0.5% by weight to about 2.75% by weight of the core, or from about 0.75% by weight to about 1.75% by weight of the core.

Coagulant Agent

A coagulant agent(s) may be added to the core herein to adjust the ionic crosslinking in the toner. In embodiments, an ionic crosslinker coagulant agent is added to the core. The ionic crosslinker coagulant agent may be added prior to aggregating the core latex, wax and the colorant. Suitable ionic crosslinker coagulant agents include, for example, coagulant agents based on aluminum such as polyaluminum halides including polyaluminum fluoride and polyaluminum chloride (PAC); polyaluminum silicates such as polyaluminum sulfosilicate (PASS); polyaluminum hydroxide; polyaluminum phosphate; aluminum sulfate; and the like. Other suitable coagulant agents include tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like.

In embodiments, the coagulant agent may be polyaluminum chloride.

The ionic crosslinker coagulant agent may be present in the core particles in amounts of from about 0.08 pph to about 0.28 pph, or from about 0.10 pph to about 0.20 pph, or from about 0.13 pph to about 0.17 pph.

Chelating Agent

A chelating agent(s) may be added to the pre-coalesced particles herein to reduce the amount of ionic crosslinking, increase the melt flow, and lower the minimum fusing temperature. Suitable chelating agents may include, for example, ethylenediaminetetraacetic acid (EDTA), gluconal, hydroxyl-2,2'iminodisuccinic acid (HIDS), dicarboxylmethyl glutamic acid (GLDA), methyl glycidyl diacetic acid (MGDA), hydroxydiethyliminodiacetic acid (HIDA), sodium gluconate, potassium citrate, sodium citrate, nitrotriacetate salt, humic acid, fulvic acid; salts of EDTA, such as, alkali metal salts of EDTA, tartaric acid, gluconic acid, oxalic acid, polyacrylates, sugar acrylates, citric acid, polyasparic acid, diethylenetriamine pentaacetate, 3-hydroxy-4-pyridinone, dopamine, eucalyptus, iminodisuccinic acid, ethylenediaminedisuccinate, polysaccharide, sodium ethylenedinitrilotetraacetate, thiamine pyrophosphate, farnesyl pyrophosphate, 2-aminoethylpyrophosphate, hydroxyl ethylidene-1,1-diphosphonic acid, aminotrimethylenephosphonic acid, diethylene triaminepentamethylene phosphonic acid, ethylenediamine tetramethylene phosphonic acid, and mixtures thereof.

The chelating agent may be present in the core particles in amounts of from about 0.05% by weight to about 1.00% by weight of the core, or from about 0.24% by weight to about 0.84% by weight of the core, or from about 0.44% by weight to about 0.64% by weight of the core.

Surfactant

One, two, or more surfactants may be used to form the core latex according to the present disclosure. The surfactant may be present in an amount of from about 0.01% by weight to about 5% by weight of the core, or from about 0.75% by weight to about 4% by weight of the core, or from about 1% by weight to about 3% by weight of the core.

Suitable anionic surfactants include sulfates and sulfonates; sodium dodecylsulfate (SDS); sodium dodecylbenzene sulfonate; sodium dodecylnaphthalene sulfate; dialkyl benzenealkyl sulfates and sulfonates; acids such as abitic acid available from Aldrich; NEOGENR™ and NEOGEN SC™ obtained from Daiichi Kogyo Seiyaku; combinations thereof; and the like. Other suitable anionic surfactants include DOWFAX™ 2A1, an alkyldiphenyloxide disulfonate from The Dow Chemical Company; and/or TAYCA POWER BN2060 from Tayca Corporation (Japan), which are branched sodium dodecyl benzene sulfonates. Combinations of these surfactants and any of the foregoing anionic surfactants may be used.

Examples of suitable nonionic surfactants include, for example, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol; nonionic surfactants available from Rhâne-Poulenc including IGEPAL CA-210™, IGEPAL CA-520™, IGEPAL CA-720™, IGEPAL CO-890™, IGEPAL CO-720™, IGEPAL CO-290™, IGEPAL CA-210TH, ANTAROX 890™, and ANTAROX 897™. Other examples of suitable nonionic surfactants include a block copolymer of polyethylene oxide and polypropylene oxide, including those commercially available from SYNPERONIC PE/F®, including SYNPERONIC PE/F 108.

Shell

The shell of the particle herein may include a latex prepared by the same method as that used to prepare the core. In embodiments, the latex of the shell may have a lower or higher weight average molecular weight (Mw) and higher glass transition temperature (Tg) than the latex of the core.

In embodiments, the Tg of the shell latex may be from about 45° C. to about 75° C., or from about 55° C. to about 65° C., or from about 58° C. to about 62° C. In embodiments, the Mw of the shell latex may be from about 15 kpse to about 60 kpse, or from about 20 kpse to about 55 kpse, or from about 30 kpse to about 50 kpse.

Useful components of the shell latex can include, for example, polymers, coagulants agents, chelating agents, and surfactants. Examples of the specific components and their respective amounts can be similar to those in the core latex.

Any method within the purview of those skilled in the art may be used to encapsulate the core within the shell, for example, by coacervation, dipping, layering, or painting. The encapsulation of the aggregated core particles may occur, for example, while heating to an elevated temperature in embodiments from about 80° C. to about 99° C., or from about 88° C. to about 98° C., or from about 90° C. to about 96° C. The formation of the shell may take place for a period of time from about 1 minute to about 5 hours, or from about 5 minutes to about 3 hours, or from about 15 minute to about 2.5 hours. The shell latex may be applied to the core until the desired final size of the toner particle is achieved.

Surface Additive Package

The surface additive package may comprise a silica mixture that includes a high charging silica compound, an aerating silica compound, and a colloidal silica compound; a polymeric spacer; and a crosslinked spacer.

High Charging Silica Compound

The high charging silica compound in the surface additive package may increase the charge of the toner composition and increase the toner flow. The term "high charging" refers to the surface treatment of the silica particle enabling increased negative charging of the toner. Some treatments are more negative than others leading to higher charging, especially in warm, humid zones. In embodiments, the high charging silica compound may be, for example, an amorphous silica ($SiO_2$) coated with silane such as, for example, octyltrimethoxysilane, AEROSIL® 380, AEROSIL® RY50, AEROSIL® RY50L, and AEROSIL® R 812 produced by Degussa-Huls; AEROSIL® NY50 produced by Nippon Aerosil, TG-5182 produced by Cabot®; and H05TD produced by Wacker.

The high charging silica compound may be hydrophobized. By hydrophobizing the surface of the silica compound, the flowability and charge properties of the toner may be improved. The high charging silica compound may be hydrophobized by a wet or dry method normally employed by a person skilled in the art, using a silane compound such as hexamethyldisilazane or dimethyldichlorosilane; or a silicone oil such as dimethyl silicone, methyl phenyl silicone, a fluorine-modified silicone oil, an alkyl-modified silicone oil, or an epoxy-modified silicone oil. The hydrophobized charged silica compounds may be, for example, commercially available AEROSIL® RY-50 and AEROSIL® NA50H produced by NIPPON AEROSIL Co., Ltd.; and TG820F and TG5182 produced by Cabot Corporation.

The high charging silica compound can have an average particle size of from about 30 nm to about 60 nm, or from about 35 nm to about 55 nm, or from about 40 nm to about 50 nm.

The amount of high charging silica compound may be, for example, from about 1% by weight to about 4% by weight of the surface additive package, or from about 1.5% by weight to about 3.8% by weight of the surface additive package, or from about 2.0 by weight to about 2.6% by weight of the surface additive package.

Aerating Silica Compound

The aerating silica compound in the surface additive package may increase the flow and aeration of the toner composition. The aerating silica compound may be, for example, untreated silica; HMDS coated silica, for example, Aerosil RX50 produced by Nippon, TG-5110 produced by Cabot®, and NAX50 produced by Degussa Huls.

The aerating silica compound can have an average particle size of from about 30 nm to about 60 nm, or from about 35 nm to about 55 nm, or from about 40 nm to about 50 nm.

The amount of aerating silica compound may be, for example, from about 0.10% by weight to about 1.5% by weight of the surface additive package, or from about 0.25% by weight to about 1.0% by weight of the surface additive package, or from about 0.35% by weight to about 0.75% by weight of the surface additive package.

Colloidal Silica Compound

The colloidal silica compound in the surface additive package may improve the durability of the toner composition and reduce fogging.

Colloidal silica can be dense, amorphous particles of $SiO_2$. The colloidal silica compound may be, for example, X-24-9163A colloidal silica sold by ShinEtsu Chemical Co. LTD, SNOWTEX® sold by Nissan Chemical Industries, TG-C110® sold by Cabot Corporation, and AEROSIL R972® sold by Degussa.

In embodiments, the colloidal silica compound may have an ultra-large silica particle, having an average particle size of from about 90 nm to about 180 nm, or from about 100 nm to about 170 nm, or from about 120 nm to about 160 nm.

The amount of colloidal silica compound may be, for example, from about 0.01% by weight to about 0.35% by weight of the surface additive package, or from about 0.05% by weight to about 0.25% weight of the surface additive package, or from about 0.10% by weight to about 0.25% by weight of the surface additive package.

Polymeric Spacer

The polymeric spacer in the surface additive package may prevent toner particles from sticking to the development roll, thereby reducing the incidence of print defects such as ghosting, white bands, and low toner density on images. The polymeric spacer may attach to the surface of the toner particles acting as a spacer-type barrier to shield the smaller surface additive package components (such as the high charging silica compound) from contact forces that may have a tendency to embed themselves in the surface of the particles.

The polymeric spacers may be, for example, polymers such as polystyrenes; fluorocarbons; polyurethanes; polyolefins including high molecular weight polymethylenes, high molecular weight polyethylenes, and high molecular weight polypropylenes; polyesters including acrylates, methacrylates, methylmethacrylates; and combinations thereof.

In embodiments, the polymeric spacers may be polymethyl methacrylate, styrene acrylates, polystyrene, fluorinated methacrylates, fluorinated polymethyl methacrylates, and combinations thereof.

In some embodiments, the polymeric spacers may be subjected to surface treatments. Such treatments include the application to the surface of the polymeric spacer, for example, silicon; zinc; silicone oils; siloxanes including polydimethylsiloxane and octamethylcyclotetrasiloxane; silanes including γ-amino tri-methoxy silane and dimethyldichlorosilane (DDS); silazanes including hexamethyldisilazane (HMDS); dimethyloctadecyl-3-trimethoxy (silyl) propyl ammonium chloride; metal salicylates having metals such as iron, zinc, aluminum, magnesium, and combinations thereof.

The polymeric spacer may have an average particle size of from about 200 nm to about 600 nm, or from about 250 nm to about 550 nm, or from about 300 nm to about 500 nm.

The amount of polymeric spacer may be, for example, from about 0.25% by weight to about 1.25% by weight of the surface additive package, or from about 0.35% by weight to about 0.85% by weight of the surface additive package, or from about 0.40% by weight to about 0.75% by weight of the surface package additive.

Crosslinked Spacer

The crosslinked spacer in the surface additive package may act as a carrier to move the toner composition through the printing system and to prevent toner particles from sticking to the development roll.

The crosslinked spacer may be, for example, melamine; styrene acrylates; styrene butadienes; styrene methacrylates, for example, poly(styrene-alkyl acrylate), poly(styrene-1,3-diene), poly(styrene-alkyl methacrylate), poly (styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly (styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly (methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly (styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and combinations thereof. The polymers may be block, random, or alternating copolymers.

The crosslinked spacer may have an average particle size of from about 200 nm to about 800 nm, or from about 250 nm to about 700 nm, or from about 300 nm to about 600 nm.

The amount of crosslinked spacer may be, for example, from about 0.01% by weight to about 0.75% by weight of the surface additive package, or from about 0.05% by weight to about 0.55% by weight of the surface additive package, or from about 0.07% by weight to about 0.25% by weight of the surface additive package.

The surface additive package may be prepared by mixing along with the toner particle the high charging silica compound, the aerating silica compound, the colloidal silica compound, the polymeric spacer, and the crosslinked spacer according to any method within the purview of those skilled in the art, including blending or mixing.

The toner composition may be prepared by mixing the particles with the surface additive package according to any method within the purview of those skilled in the art, including mixing, rolling, or dipping.

EXAMPLE

Preparing the Toner Particle

The following Example illustrates one exemplary embodiment of the present disclosure. This Example is intended to be illustrative only to show one of several methods of preparing the low energy consumption monochrome particle and is not intended to limit the scope of the present disclosure. Also, parts and percentages are by weight unless otherwise indicated.

A monomer in water emulsion was prepared by agitating a monomer mixture of about 29 parts by weight styrene, about 9.8 parts by weight n-butyl acrylate, about 1.17 parts by weight beta-carboxyethylacrylate (Beta CEA), about 0.20 parts by weight 1-dodecanethiol with an aqueous solution of about 0.77 parts by weight of DOWFAX™ 2A1 (an alkyldiphenyloxide disulfonate surfactant sold by Dow Chemical), and about 18.5 parts by weight of distilled water at about 500 revolutions per minute (rpm) at a temperature of from about 20° C. to about 25° C.

About 0.06 parts by weight of DOWFAX™ 2A1 and about 36 parts by weight of distilled water were charged in an 8 liter jacketed glass reactor with a stainless steel impeller at about 200 rpm, a thermal couple temperature probe, a water cooled condenser with nitrogen outlet, a nitrogen inlet, internal cooling capabilities, and a hot water circulating bath set at about 83° C., and de-aerated for about 30 minutes while the temperature was raised to about 75° C.

About 1.2 parts by weight of the monomer emulsion described above was then added into the reactor and was stirred for about 10 minutes at about 75° C. An initiator solution prepared from about 0.78 parts by weight of ammonium persulfate in about 2.7 parts by weight of distilled water was added to the reactor over about 20 minutes. Stirring continued for about an additional 20 minutes to allow seed particle formation. The remaining monomer emulsion was then fed into the reactor over a time period of about 190 minutes. After the addition, the latex was stirred at the same temperature for about 3 more hours to complete conversion of the monomer. Latex made by the process of semi-continuous emulsion polymerization resulted in latex particle sizes between 150 nm to 250 nm.

Synthesis of EA Particle (Reference Particle)

To a 2 liter jacketed glass lab reactor, about 378 parts by weight of a core latex, which was prepared by the process of semi-continuous emulsion polymerization as described in the latex synthesis example, about 65 parts by weight of a Regal 330 pigment dispersion, about 22 parts by weight of a cyan pigment blue 15:3 pigment dispersion, about 184 parts by weight of a paraffin wax dispersion, and about 760 parts by weight of distilled water, were added. The components were mixed by a homogenizer for about 2-3 minutes at about 4000 rpm. With continued homogenization, a separate mixture of about 4.4 parts by weight of poly (aluminum chloride) in about 30 parts by weight of 0.02 M of $HNO_3$ solution was added drop-wise into the reactor. After the addition of the poly (aluminum chloride) mixture, the resulting viscous slurry was further homogenized at about 20° C. for about 20 minutes at about 4000 rpm. At this time the homogenizer was removed and replaced with a stainless steel impeller and stirred continuously at about 350 to 300 rpm, while raising the temperature of the contents of the reactor to about 54.7° C. The batch was held at this temperature until a core particle size of about 6.9 microns was achieved.

A shell was added to the core by the following process. While stirring continuously at about 300 rpm, about 240 parts by weight of a shell latex, which was prepared by the process of semi-continuous emulsion polymerization described in the emulsion polymerization example, was added drop-wise, over a period of about 10 minutes, to the reactor containing the core particle having a particle size of about 6.9 microns. After the complete addition of the latex, the resulting particle slurry was stirred for about 30 minutes, at which time about 6.25 parts of tetra sodium salt of ethylenediaminetetraacetic acid and a sufficient amount of 1 molar NaOH was added to the slurry to adjust the pH of the slurry to about 5.7. After the pH adjustment, the stirrer speed was lowered to about 160 rpm for an additional 10 minutes. At the end of the 10 minutes, the bath temperature was adjusted to about 98° C. to heat the slurry to about 96° C. During the temperature increase, the pH of the slurry was adjusted to about 5.3 by the addition of a sufficient amount of a 0.3 M $HNO_3$ solution at about 80° C. The slurry temperature was then allowed to increase to about 96.1° C. and was maintained at 96.1° C. to complete coalescence in about 260 minutes. At this time, a sufficient amount of 1 molar NaOH was added to the particle slurry to adjust the pH to about 6.9, and the slurry was immediately cooled to about 63° C. Upon reaching 63° C., the particle slurry was again pH adjusted with a sufficient amount of 1 molar NaOH to obtain a pH of 8.8, followed by immediate cooling to about 30° C. to 35° C. At this time, the low energy consumption monochrome particles were washed several times and dried.

The resulting particles had an average diameter of 7.42 μm, a GSDv of 1.182, a GSDn of 1.21, and a circularity of 0.959. The glass transition temperature Tg of the particles was 47° C.

Tables I and II show the low energy consumption monochrome particles according to the present disclosure (Formulation 1) compared with a control. As can be seen from the table, the particles are very similar in size and shape. Surface wax is noted to be higher at room temperature, 50° C. and 75° C. This is shown to give improved minimum fusing as well as improved release. Once at 90° C. both particles show equivalent surface wax levels. BET is similar to the control, being an optimized particle shape for improved cleaning. The melt flow index (MFI) at 125° C. and 5 kg is increased from the control also, allowing for better flow and fusing. Tg of the material is similar to the control allowing for better anti-blocking properties. Molecular weights are low, also lending improved rheological characteristics when fused.

TABLE I

| Toner | Volume Number PS (um) | 84/50 GSD | 50/16 GSD | Circularity | XPS % weight wax on surface (RT) | % weight wax on surface (50deg C.) | % weight wax on surface (75deg C.) | % weight wax on surface (90deg C.) |
|---|---|---|---|---|---|---|---|---|
| Formulation 1 (Low Melt) | 7.42 | 1.182 | 1.21 | 0.959 | 15 | 19 | 85 | 94 |
| Control | 7.55 | 1.181 | 1.2 | 0.960 | 12 | 16 | 63 | 93 |

TABLE II

| Toner | BET (m2/g) multi | BET (m2/g) single | MFI (125° C. 5.0 kg) (g/10 min) | Tg (onset) (° C.) | Midpt. Tg (° C.) | Mw (pse) | Mn (pse) | Mz (pse) | Mp (pse) | MWD |
|---|---|---|---|---|---|---|---|---|---|---|
| Formulation 1 (Low Melt) | 1.06 | 1.19 | 15.5 | 47 | 53.3 | 29,117 | 13,312 | 57,604 | 19,226 | 2.19 |
| Control | 1.09 | 0.991 | 9.5 | 46.6 | 53.4 | 31,101 | 13,693 | 65,300 | 19,628 | 2.27 |

Table III shows the blend additive levels in general in the surface additive package of embodiments herein.

TABLE III

| Additive | % Ranges |
|---|---|
| 40 nm High Charging Silica | 2.0-3.0 |
| 40 nm Aerating Silica | 0.1-0.75 |
| 140 nm Colloidal Silica | 0.05-0.35 |

TABLE III-continued

| Additive | % Ranges |
|---|---|
| 500 nm Polymeric Spacer | 0.25-0.75 |
| 300 nm Polymeric Crosslinked Spacer | 0.01-0.35 |
| Total: | 2.41-5.20 |

The toner particles were blended with the surface additive package (high charging silica, aerating silica, colloidal silica, polymeric spacer, and polymeric crosslinked spacer) in a Henshel blender at 3000 rpm for 25 minutes total. Once blended, the toner was placed in the SCD cartridge at a loading of 150 gm. Prints were made on standard Xerox 4200 paper as well as FX P paper for HOT offset testing.

Formulation 1 had equal or better results than the control sample when tested over 40,000 prints.

Toner Characteristics

The toner according to the present disclosure in a core-shell configuration can have an average particle size from about 5 microns to about 10 microns, or from about 6 microns to about 9 microns, or from about 7 microns to about 8 microns.

In a core-shell configuration, the toner particles according to the present disclosure may have a circularity of from about 0.940 to about 0.975, or from about 0.950 to about 0.970, or from about 0.955 to about 0.965. A circularity of 1.000 indicates a completely circular sphere. Circularity may be measured with, for example, a Sysmex FPIA 2100 or 3000 analyzer.

The toner according to the present disclosure provides a toner with excellent anti-blocking test results that does not show any agglomeration at 50 C for 48 hours.

The toner according to the present disclosure may exhibit a hot offset temperature of, for example, from about 200° C. to about 230° C., or from about 200° C. to about 220° C., or from about 205° C. to about 215° C.

Toner according to the present disclosure may have a flow, measured by Hosakawa Powder Flow Tester, or for example, from about 25% weight to about 55% weight, or from about 30% weight to about 50% weight, or from about 35% weight to about 45% weight.

The toner may have a gloss, measured at the minimum fixing temperature (MFT), of from about 0 gloss units to about 30 gloss units, or from about 5 gloss units to about 25 gloss units, or from about 10 gloss units to about 20 gloss units as measured on a BYK 75 degree micro gloss meter. "Gloss units" refers to Gardner Gloss Units (ggu) measured on plain paper (such as Xerox 90 gsm COLOR XPRESSIONS+ paper or Xerox 4200 paper.

Also, the toner according to embodiments herein can reduce toner usage, such as less than about 0.75 mg/cm$^2$. Using the toner herein, fuser temperature may be lowered to about 185° C. rather than about 195° C. in the absence of the toner particles herein.

It will be appreciated that variations of the above-disclosed and other features and functions, or alternatives thereof, may be desirably combined into many other different systems or applications. Also that various, presently unforeseen or unanticipated, alternatives, modifications, variations or improvements therein may be subsequently made by those skilled in the art which are also intended to be encompassed by the following claims.

What is claimed is:

1. A low energy consumption monochrome toner having a surface additive package consisting of:

a high charging silica compound consisting of an amorphous silica coated with octyltrimethoxysilane, an aerating silica compound consisting of untreated silica, a colloidal silica compound consisting of dense, amorphous particles of silicon dioxide, a polymeric spacer, a crosslinked spacer; and wherein the toner provides a fusing temperature of about 185° C., wherein the toner comprises a monomer comprising styrene, n-butylacrylate, and beta carboxyethylacrylate at a respective ratio of about 83/17/5 parts to about 70/30/2 parts.

2. The low energy consumption monochrome toner according to claim 1, wherein the high charging silica compound is present in an amount of from about 2% by weight to about 3% by weight of the surface additive package.

3. The low energy consumption monochrome toner according to claim 1, wherein the aerating silica compound is present in an amount of from about 0.10% by weight to about 0.90% by weight of the surface additive package.

4. The low energy consumption monochrome toner according to claim 1, wherein the colloidal silica compound is present in an amount of from about 0.01% by weight to about 0.35% by weight of the surface additive package.

5. The low energy consumption monochrome toner according to claim 1, wherein the polymeric spacer is present in an amount of from about 0.25% by weight to about 0.85% by weight of the surface additive package.

6. The low energy consumption monochrome toner according to claim 1, wherein the crosslinked spacer is present in an amount of from about 0.01% by weight to about 0.35% by weight of the surface additive package.

7. A low energy consumption monochrome toner, comprising:

a core latex comprising a monomer including styrene, n-butylacrylate, and beta carboxyethylacrylate;

a surface additive package consisting of a silica mixture having a high charging silica compound consisting of an amorphous silica coated with octyltrimethoxysilane; a polymeric spacer; and a crosslinked spacer;

wherein the polymeric spacer is selected from the group consisting of styrene acrylates, polystyrene, fluorinated methacrylates, and combinations thereof; and wherein the toner has a gloss of 0 ggu.

8. The low energy consumption monochrome toner according to claim 7, wherein the silica mixture further comprises an untreated silica.

9. The low energy consumption monochrome toner according to claim 7, wherein the silica mixture further comprises dense, amorphous particles of SiO2.

10. The low energy consumption monochrome toner according to claim 7, wherein the crosslinked spacer is selected from the group comprising melamine, styrene acrylates, styrene butadienes, styrene methacrylates, poly(styrene-alkyl acrylate), poly(styrene-1,3-diene), poly(styrene-alkyl methacrylate), poly (styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly (aryl methacrylate-alkyl acrylate), poly(alkyl methacrylate-acrylic acid), poly(styrene-alkyl acrylate-acrylonitrile-acrylic acid), poly (styrene-1,3-diene-acrylonitrile-acrylic acid), poly(alkyl acrylate-acrylonitrile-acrylic acid), poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly (methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly (styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly(styrene-butadiene), poly(styrene-isoprene), poly(styrene-butyl methacrylate), poly(styrene-butyl acrylate-acrylic acid), poly(styrene-butyl methacrylate-acrylic acid), poly(butyl methacrylate-butyl acrylate), poly(butyl methacrylate-acrylic acid), poly (acrylonitrile-butyl acrylate-acrylic acid), and combinations thereof.

11. The low energy consumption monochrome toner according to claim 7, wherein the toner further includes a shell latex having a weight average molecular weight (Mw) of from about 15 kpse to about 65 kpse and a glass transition temperature (Tg) of from about 45° C. to about 75°.

12. A low energy consumption monochrome toner, comprising:

a core latex comprising a monomer;

a shell latex over the core latex;

and a surface additive package, over the shell latex, the surface additive package including a high charging silica, an aerating silica, a colloidal silica, a polymeric spacer, and a crosslinked spacer;

wherein the high charging silica is present at 2.0-3.0 weight percent of the toner;

wherein the aerating silica is present at 0.1 to 0.75 weight percent of the toner;

wherein the colloidal silica is present at 0.05-0.35 weight percent of the toner;

wherein the polymeric spacer is present at 0.25-0.75 weight percent of the toner; and wherein the crosslinked spacer is present at 0.01-0.35 weight percent of the toner.

13. The low energy consumption monochrome toner according to claim 12, wherein the core latex has a weight average molecular weight (Mw) of from about 15 kpse to about 60 kpse and a glass transition temperature (Tg) of from about 35° C. to about 75°.

14. The low energy consumption monochrome toner according to claim 12, wherein a toner particle, of the toner, has a circularity of from about 0.940 to about 0.975.

15. The low energy consumption monochrome toner according to claim 12, wherein the toner has a gloss of 0 ggu.

16. The low energy consumption monochrome toner according to claim 12, wherein the toner has a hot offset temperature of from about 200° C. to about 230° C.

17. The low energy consumption monochrome toner according to claim 7, wherein the respective ratio of styrene, n-butylacrylate, and beta carboxyethylacrylate is at about 83/17/5 parts to about 70/30/2 parts.

18. The low energy consumption monochrome toner according to claim 12, wherein the monomer includes styrene, n-butylacrylate, and beta carboxyethylacrylate at a respective ratio of about 83/17/5 parts to about 70/30/2 parts.

* * * * *